United States Patent [19]

Deibele et al.

[11] Patent Number: 4,833,853

[45] Date of Patent: May 30, 1989

[54] SECURING FASTENER FOR WATERPROOF ROOF

[75] Inventors: Charles Deibele; Albert Deibele, Jr., both of Kiel, Wis.

[73] Assignee: Household Utilities, Inc., Kiel, Wis.

[21] Appl. No.: 207,314

[22] Filed: Jun. 15, 1988

[51] Int. Cl.[4] ..... E04B 5/00

[52] U.S. Cl. ..... 52/410; 52/462; 52/465; 52/520; 52/746

[58] Field of Search ..... 52/222, 63, 83, 461, 52/462, 465, 466, 467, 410, 520, 746

[56] References Cited

U.S. PATENT DOCUMENTS

| | | | |
|---|---|---|---|
| 872,018 | 11/1907 | Repp | 52/462 |
| 1,144,265 | 6/1915 | Von Uffel | 52/462 |
| 1,147,582 | 7/1915 | Von Uffel | 52/462 |
| 3,323,819 | 6/1967 | Barker . | |
| 3,574,985 | 4/1971 | Pierce et al. | 52/468 |
| 3,895,468 | 7/1975 | Bernstein | 52/222 |
| 4,231,141 | 11/1980 | Derrick et al. | 160/395 |
| 4,246,735 | 1/1981 | Herzfeld | 52/465 |
| 4,366,656 | 1/1983 | Simpson | 52/520 X |
| 4,502,256 | 3/1985 | Hahn | 52/63 |
| 4,506,479 | 3/1985 | Matthison-Hansen | 52/466 X |
| 4,519,172 | 5/1985 | Ristow | 52/465 X |
| 4,520,606 | 6/1985 | Francovitch | 52/410 |
| 4,534,145 | 8/1985 | Yang et al. | 52/222 |
| 4,543,758 | 10/1985 | Lane | 52/410 |
| 4,566,236 | 1/1986 | Pound | 52/222 |
| 4,586,301 | 5/1986 | Hickman | 52/96 |
| 4,631,887 | 12/1986 | Francovitch | 52/410 |
| 4,694,543 | 9/1987 | Conley | 52/222 X |

FOREIGN PATENT DOCUMENTS

| | | | |
|---|---|---|---|
| 2344465 | 3/1975 | Fed. Rep. of Germany | 52/461 |

*Primary Examiner*—James L. Ridgill, Jr.
*Attorney, Agent, or Firm*—Andrus, Sceales, Starke & Sawall

[57] ABSTRACT

A fastener for securing a flexible waterproof sheet to a supporting roof structure. The fastener includes an elongated mounting bracket having a base and a body including an upstanding central portion and a pair of wing members extending laterally from opposite sides of the central portion of the body. Each of the wing members include an outer tip spaced above the base which defines a sheet-receiving recess therebetween. The fastener also includes an elongated cap member for attaching a flexible waterproof sheet to the bracket. The cap member includes a top and a pair of opposite depending flange members each including outer edges which are movable between a first expanded position loosely surrounding the body of the mounting bracket and a second contracted position wherein the outer edges are disposed within the sheet-receiving recesses for sandwiching a waterproof sheet between the cap and the wing members so that the sheet is clamped therebetween and a waterproof seal is provided by the sheet bearing against the wing members. A method of securing a flexible waterproof sheet on a supporting roof structure is also disclosed.

14 Claims, 2 Drawing Sheets

SECURING FASTENER FOR WATERPROOF ROOF

BACKGROUND OF THE INVENTION

The present invention relates to waterproof roofs, and more particularly to a fastener for securing a flexible waterproof sheet on a supporting roof structure.

Roofs are typically waterproofed by applying segments of sheathing material or sheets which are composed of a waterproof material on the supporting roof structure. These sheets of waterproof material are secured to the supporting roof structure by a plurality of elongated fastening devices which are arranged in spaced relationship along the supporting roof structure. Various types of fastening devices have been utilized in the past, directed to the following U.S. patents which disclose various means for securing sheet material to a supporting structure.

| U.S. Pat. No. | Inventor |
|---|---|
| 4,234,799 | Eason |
| 3,323,819 | Barker |
| 3,574,985 | Pierce |
| 3,895,468 | Bernstein |
| 4,231,141 | Derrick et al |
| 4,246,735 | Herzfeld |
| 4,366,656 | Simpson |
| 4,502,256 | Hahn |
| 4,506,479 | Matthison-Hansen |
| 4,519,172 | Ristow |
| 4,534,145 | Yang et al |
| 4,566,236 | Pound |
| 4,586,301 | Hickman |
| 4,631,887 | Francovitch |
| 4,694,543 | Conley |

The cited patents illustrate both penetrating and nonpenetrating type of devices for securing sheet material. The Ristow patent is of the penetrating type wherein a fastener actually passes through the sheet member to secure the sheet member in place. In practice, devices that penetrate the sheet member have been found to be undesirable due to the inherent contradication of puncturing a sheet member that is supposed to function as a waterproofing membrane. The Bernstein patent and the Derrick et al patent, for example, illustrate nonpenetrating types of fasteners wherein an overlying clip secures the sheet member to the underlying support structure without penetrating the sheet material.

Fastening devices for securing waterproofing membranes on roofs should also be attached to the underlying support structure in such a manner to provide uniform loading so as to eliminate distortion and permanent deformation of the device by wind uplift forces. Alternate side fastening such as that utilized in the Ristow patent creates uneven loading with varying force moments and levers at severe wind uplift loads to yield permanent distortion and deformation. Further, the manner of fastening the base member to the supporting roof shown, for example, in Ristow may result in screws loosening and backing out which not only endangers the structural integrity of the device but may also puncture the membrane, or may result in the heads of screws actually being stripped out of the base member under severe load conditions. Any of the above conditions may demand product replacement for aesthetic or functional reasons.

SUMMARY OF THE INVENTION

A fastener for securing a flexible waterproof sheet on a supporting roof structure. The fastener includes an elongated mounting bracket having a base and a body including a central portion connected to and upstanding from the base together with a pair of wing members extending laterally from opposite sides of the central portion of the body with each of the wing members including an outer tip spaced above the base which defines a sheet receiving recess therebetween, fastener means for fastening the mounting bracket to a supporting roof structure, and an elongated cap member for attaching a flexible waterproof sheet to the bracket. The cap member includes a pair of opposite depending flange members each including outer edges with the flange members movable between a first expanded position surrounding the body of the bracket and a second contracted position wherein the outer edges are disposed within the sheet-receiving recesses formed by the bracket to sandwich the sheet between the cap member and the wing members so that the sheet is clamped therebetween and a waterproof seal is provided by the sheet bearing against the wing members.

In one form, the base comprises a pair of opposite laterally extending legs and the central portion of the body comprises a pair of upright spaced side walls integral at their lower ends with the legs and at their upper ends with the wing members. The upright side walls provide a rigid structure to support the screw fastener and thus prevent the screw from being stripped out of the base member under severe load conditions, in a manner analogous to the strength of an I-beam versus the strength of a single layer of metal sheet material. Also, the tips of the wing members are integrally connected to one of the side walls of the central body portion by a lower wall and to each other by an upper wall which is preferably arcuate or domeshaped.

The cap member may also include abutment means engageable with the flexible sheet to force the flexible sheet tightly against the upper wall of the wing members when the cap member is in its contracted position for providing a longitudinal seal between the cap member and the upper wall. The cap member also includes stop means for preventing the screw fastener from backing out of the bracket. Preferably, this abutment means and stop means comprises a continuous V-shaped channel member disposed between and interconnecting the opposite depending flange members. When the present fastener device is employed at an overlapping joint of two adjacent membrane segments, sealing means such as an adhesive compound may be disposed between the membranes at any location along the upper wall between the tips of the wings of the base member prior to the crimping of the cap member on the base member to provide a concealed, protected, continuous bond between the membranes.

In one embodiment, the fastener means comprises a screw which engages solely the bracket in such a manner that its head bears against the upper wall of the wing members and extends through the central portion of the body into a supporting roof structure. In another embodiment, the bracket is fastened to the corner of a supporting roof structure by screws extending through the legs of the base.

In another apsect of the invention, a method of securing a flexible waterproof sheet on a supporting roof structure is provided. This method includes providing a fastener of the above-described type, attaching the bracket of the fastener to a supporting roof structure, positioning a flexible waterproof sheet over the wing members of the bracket body, tucking the flexible sheet into one of the sheet-receiving recesses defined by the bracket, inserting an outer edge of one of the flange members of the cap member into the one sheet-receiving recess, rolling the cap member over the bracket member, and finally crimping the flange members of the cap member toward each other until the outer edges of the flange members are disposed within the sheet-receiving recesses to sandwich and secure the sheet therebetween and provide a waterproof seal along the sheet-receiving recesses by the sheet bearing against the wing members. The step of crimping simultaneously moves the V-shaped top of the cap member downwardly against the upper wall of the wing members to provide a longitudinal seal between the top of the cap member and the upper wall of the wing members.

The present invention thus provides a fastener of the nonpenetrating type that not only provides a continuous waterproof seal all along the top of the device but also seals all along both sides of the device. In addition, the cap member includes stop means for preventing the fastener that secures the bracket to the supporting roof structure from loosening and backing out of its normal position thus eliminating the possiblity of puncturing the membrane.

Centerline fastening by the screw that secures the bracket to the supporting roof structure provides uniform loading against wind uplift forces and inherently provides a uniform strength which eliminates and/or minimizes distortion of the device even at extreme loads. Recesses or indentations are formed at regular intervals along the top of the upper wall of the bracket to provide efficient fastening of the bracket to the supporting roof structure so as to yield a predetermined maximum designed uplift strength with the minimum number of screw fasteners. The determining factor being the type and/or gauge of the substrate and the pullout strength of the screw fastener when utilized with a respective substrate. In another aspect, the device, once assembled, prevents the screw fastener from penetrating or damaging the membrane if the fastener does not sufficiently compress the bracket member tightly to the substrate or supporting roof structure. In another words, the screw fastener is locked between the assembly, i.e. between the bracket and cap member thus making it impossible to move relative to the bracket member or cap member thus eliminating and/or minimizing distortion and permanent deformation since the continuous seamed attachment of the bracket and cap eliminates any movement between these componentes. The design also provides a rigid structure to support the screw fastener and prevent the screw fastener from being stripped out of the base member under severe load conditions.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
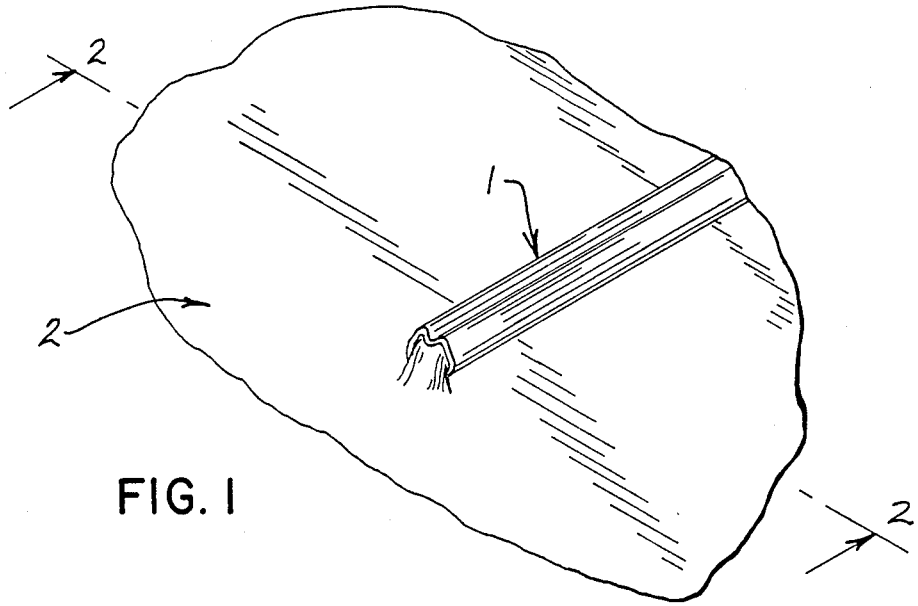
FIG. 1 illustrates a fragmentary perspective view of a waterproof roof incorporating a fastener constructed in accordance with the present invention.

Referring now to the drawings, FIG. 1 illustrates a fastener generally designated by the numeral 1 for securing a flexible waterproof sheet or membrane 2 on a supporting roof structure. In a typical roof installation, a plurality of fasterners 1 are placed in parallel relationship at regular intervals along the extent of the supporting roof structure and thereby provide a means for securing the membrane or sheet 2 to the supporting roof structure.

Figure 2:
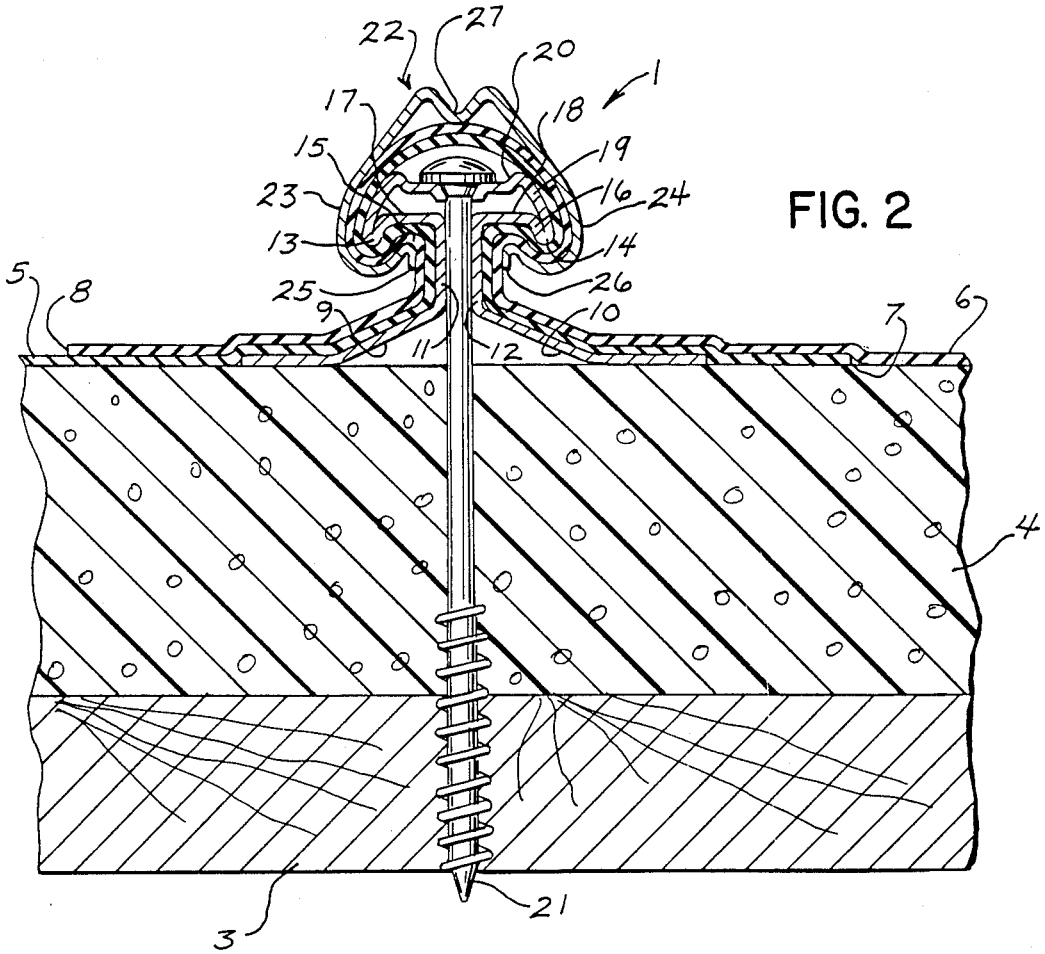
FIG. 2 is a cross sectional view in elevation of the roof taken along the plane of the line 2—2 in FIG. 1.

A shown best in FIG. 2, the supporting roof structure can be generally horizontal, as shown in FIG. 1, or inclined or domed. The contour of the supporting roof structure and wind uplift considerations determine the arrangement and spacing of fasteners 1. As shown, the supporting roof structure typically includes a substrate comprised of a wooden flat member 3 supporting insulation 4 on which fastener 1 is positioned. However, flat member 3 may also be composed of other rigid materials such as relatively thin or thick gauge sheet metal.

The sheet or membrane 2 is generally elastic so as to provide a flexible waterproof member for preventing water infiltration through the roof structure. The sheet 2 can be made from either ethylene propylene dioxide methane (EPDM) or polyvinyl chloride (PVC), or any other suitable material for elastic waterproof membranes with the choice of material depending on the conditions expected for the waterproof roof. The sheet 2 may also be reinforced with mesh (not shown) if desired.

Sheet 2 generally includes a plurality of segments arranged in parallel relationship and regular intervals along the extent of the supporting roof structure. FIG. 2 illustrates two of such segments 5, 6 each including edges 7, 8 respectively. As shown in FIG. 2, edges 7, 8 will usually be overlapped to facilitate their connection by fastener 1 on the supporting roof structure.

As shown in FIG. 2, each fastener 1 includes an elongated mounting bracket having a base which inldues a pair of opposite laterally extending legs 9, 10, and a body including a central portion connected to and upstanding from the base which comprises a pair of upright spaced side walls 11, 12 integral at their lower end with legs 9, 10 respectively. The body also includes a pair of wing members extending laterally from opposite sides of the upright central portion with each of the wing members including an outer tip 13, 14 respectively spaced above legs 9, 10 which define a pair of elongated sheet-receiving recesses 15, 16 respectively. As shown, the tips 13, 14 of the wing members are integrally connected to one of the side walls 11, 12 of the central body portion by a lower wall 17, 18 and to each other by an upper wall 19 which is dome-shaped. Recesses or indentations 20 are formed at regular intervals along the extent of upper wall 19 (only one of which is shown in FIG. 2). Identations 20 receive the head of a fastener, typically a screw 21, so that the head of screw 21 is recessed from the outer surface of upper wall 19. As shown, the shank of screw 21 extends through the space provided between upright side walls 11, 12, through insulation 4, and into roof member 3.

Figure 3:
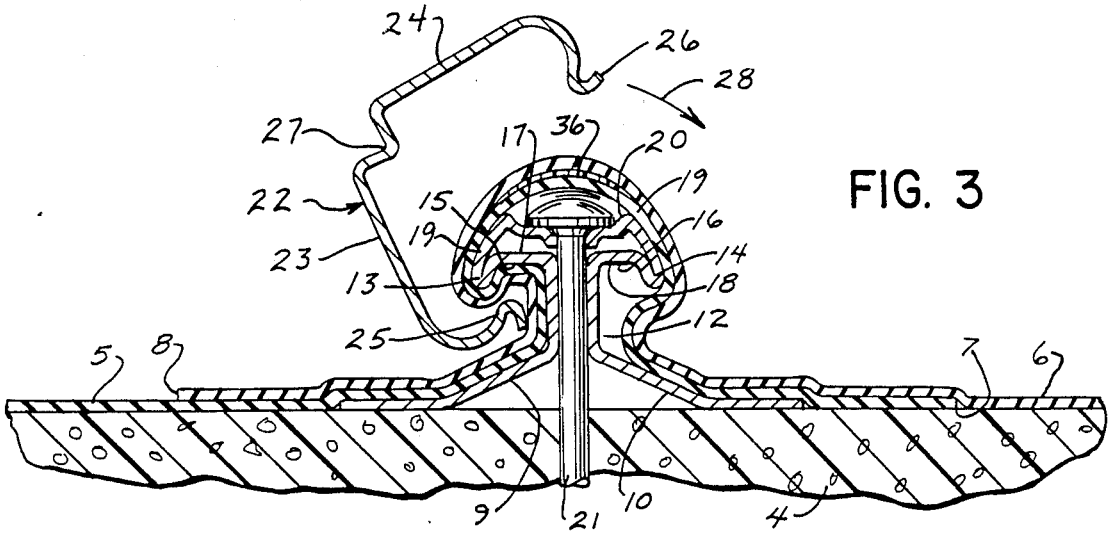
FIG. 3 is a cross sectional view similar to FIG. 2 illustrating the manner of attaching the cap member to the bracket of the fastener.

Fastener 1 also includes an elongated rigid cap member 22 for attaching sheet segments 5, 6 to the bracket member. Cap member 22 includes a pair of opposite depending flange members 23, 24 each including outer edges 25, 26 respectively at their lower ends. Flange members 23, 24 are interconnected at their upper ends or top by a continuous V-shaped channel member 27. As shown best in FIG. 2, when cap member 22 is assembled sheet segments 5, 6 are sandwiched between the inner surface of cap member 22 and the outer surface of the bracket member. In order to accomplish this, flange members 23, 24 of cap member 22 are movable between a first expanded position loosely surrounding the bracket member and sheet segments 5, 6 and a second contracted position wherein the outer edges 25, 26 are disposed within the sheet-receiving recesses 15, 16 so that the sheet segments 5, 6 are clamped therebetween. A waterproof seal is provided along each side of the bracket member by the sheet segments 5, 6 bearing tightly against the lower walls 17, 18 of the wing members in sheet-receiving recesses 15, 16. An additional seal is provided by means of the lower edge of channel member 27 functioning as an abutment and engaing sheet segment 6 to force sheet segments 6 and 5 against the upper wall 19 of the wing members when cap member 22 is in its contracted position which provides a longitudinal seal along the top of upper wall 19. Channel member 27 also functions as a stop member for preventing screw 21 from loosening and backing out of member 3. As shown in FIG. 3, a sealant material 36 may be applied between sheet segments 5, 6. The sealant material 36 may be applied in a continuous manner at any location between tips 13, 14 to provide a concealed, protected, continuous bond between membranes 5, 6, if desired.

As shown best in FIG. 3, in order to secure the sheet segments 5, 6 to the supporting roof structure, the mounting bracket is first attached to the supporting roof structure by means of a plurality of screws 21 extending therethrough into member 3. Thereafter, the sheet segments 5, 6 are positioned over the wing members of the bracket body in an overlapped relationship, and one side of the segments 5, 6 is tucked into sheet-receiving recess 15. The outer edge 25 of flange member 23 is then inserted into sheet-receiving recess 15 along the entire length thereof and rolled over the bracket member in the direction shown by arrow 28 in FIG. 3. In this position, cap member 22 is in its expanded condition. Thereafter, flange members 23, 24 are crimped along their longitudinal length into the contracted position as shown in FIG. 2. Thus, outer edges 25, 26 of flange members 23, 24 are moved toward each other until they are disposed within the sheet-receiving recesses 15, 16 to sandwich and secure the sheet segments 5, 6 therebetween and provide a waterproof seal along the recesses 15, 16 by the sheet segments 5, 6 bearing against the lower walls 17, 18 of the wing members within recesses 15, 16. Crimping of the flange members 23, 24 simultaneously moves the lower edge of channel member 27 downwardly against the upper wall 19 of the wing members to provide a longitudinal seal between the cap member 22 and the upper wall 19 of the wing members. As shown, when assembled, cap member 22 also prevents screw 21 from loosening and backing out from the position shown in FIG. 2.

After a first fastener 1 is assembled in the manner described, a second faster (not shown) is placed in parallel relationship at a spaced interval so as to secure the overlapping edges of the next adjacent sheet segment in the same manner as previously described. This procedure eliminates any tensioning of the sheet segments which might cause premature tearing or failure of the waterproof sheet. This elimination of tensioning of the sheet material provides a significant advantage over prior art fastener devices and, as noted, in particular eliminates premature failure of the waterproof sheet.

Figure 4:
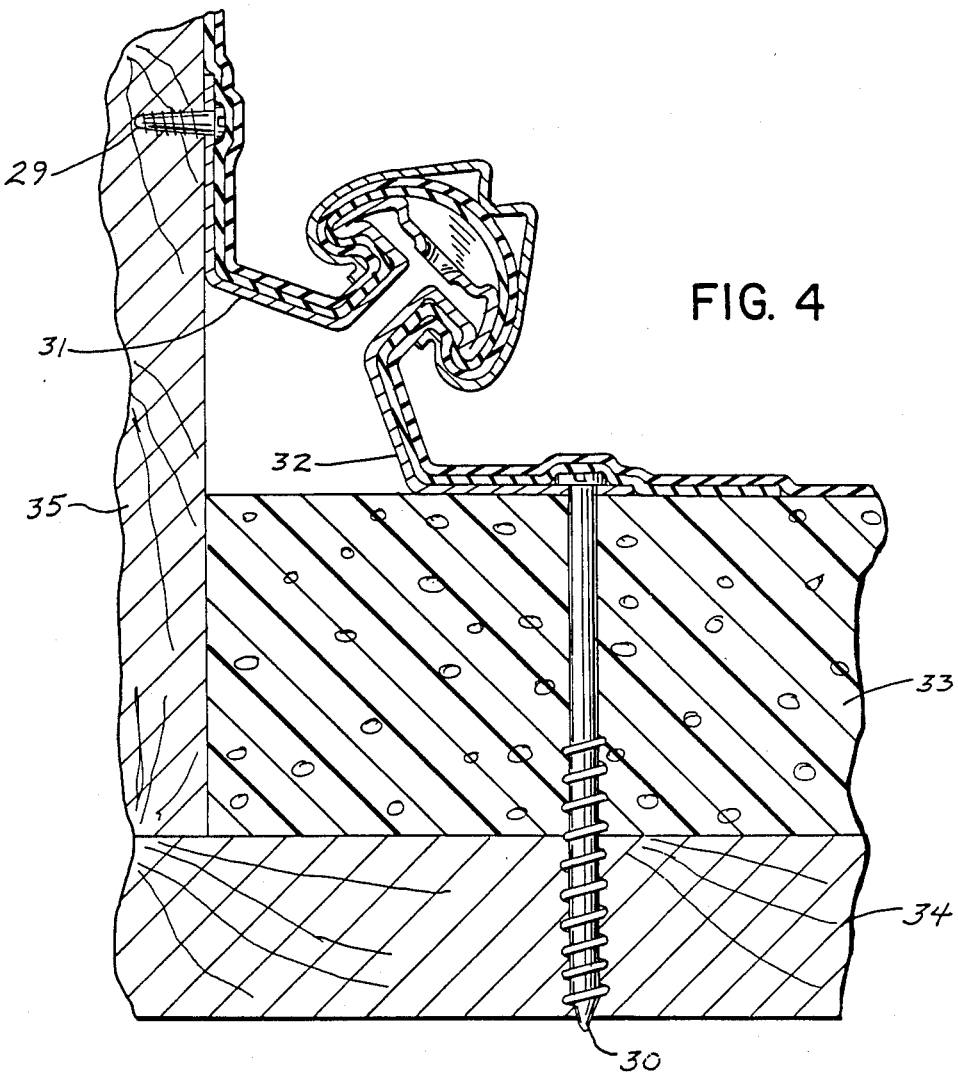
FIG. 4 is a fragmentary cross sectional view in elevation of a corner of the roof shown in FIG. 1.

FIG. 4 illustrates an alternate embodiment for fastener 1. In this embodiment, fastener 1 is employed at the corner of a roof structure. In this embodiment, fastener 1 is connected to the supporting roof structure by means of screws 29, 30 extending through legs 31, 32 of the bracket member. As shown, legs 31, 32 are similar to legs 9, 10 of the first embodiment except that legs 31, 32 are longer and disposed at a slightly greater angle in order to accommodate screws 29, 30. In all other respects, the structure of the fastener shown in FIG. 4 is identical to the fastener shown in FIG. 2. Note that screw 30 must extend through an overlying layer of insulation 33 into member 34 and thus needs to be longer than screw 29 which threads directly into member 35 of the supporting roof structure.

A fastener for securing a waterproof sheet to a supporting roof structure has been illustrated and described to provide a waterproof roof. It should be noted that various modifications and/or substitutions of the specific components described and illustrated herein may be made without departing from the scope of the present invention. For example, the specific materials of composition may be varied depending upon the desired application.

Various modes of carrying out the invention are contemplated as being within the scope of the following claims particularly pointing out and distinctly claiming the subject regarded as the invention.

We claim:

1. A fastener for securing a flexible, waterproof sheet on a supporting roof structure, comprising:

an elongated mounting bracket having a base and a body including a central portion connected to and upstanding from said base, said body including a pair of wing members extending laterally from opposite sides of the central portion of said body, each of said wing members including an outer tip spaced above said base which defines a sheet-receiving recess;

fastener means for fastening said mounting bracket to a supporting roof structure; and an elongated substantially rigid cap member for attaching a flexible waterproof sheet to said bracket, said cap member including a pair of opposite flange members each including outer edges, said flange members movable between a first expanded position surrounding said body and a second contracted position wherein said outer edges are disposed within said sheet-receiving recesses for sandwiching said sheet between said cap member and said wing members so that said sheet is clamped therebetween and a waterproof seal is provided by said sheet bearing against said wing members.

2. The fastener of claim 1 wherein a pair of flexible waterproof sheets are sandwiched between said cap member and wing members, and further including sealing means disposed betwen said pair of flexible waterproof sheets.

3. The fastener of claim 2 wherein said sealing means comprises a sealant compound.

4. The fastener of claim 1 wherein said fastener means engages solely said bracket and bears against said wing members and extends through the central portion of said body into a supporting roof structure.

5. The fastener of claim 4 wherein said fastener means comprises a screw.

6. The fastener of claim 4 wherein said cap member further includes stop means disposed for preventing said fastener means from backing out of said bracket.

7. The fastener of claim 6 wherein said stop means comprises a V-shaped channel member disposed between and interconnecting said opposite flange members.

8. The fastener of claim 1 wherein said base comprises a pair of opposite laterally extending legs and said central portion of said body comprises a pair of upright spaced side walls integral at their lower ends with said legs and at their upper ends with said wing members.

9. The fastener of claim 8 wherein each of the tips of said wing members are integrally connected to one of said side walls of said central body portion by a lower wall and to each other by an upper wall.

10. The fastener of claim 9 wherein said upper wall is dome-shaped.

11. The fastener of claim 9 wherein said cap member further includes abutment means engageable with said flexible sheet to force said flexible sheet against said upper wall when said cap member is in said contracted position for providing a longitudinal seal between said cap member and said upper wall.

12. The fastener of claim 11 wherein said abutment means comprises a V-shaped channel member disposed between and inerconnecting said opposite flange members.

13. A method of securing a flexible waterproof sheet on a supporting roof structure comprising the steps of:

providing a fastener which includes an elongated mounting bracket and an elongated cap member, said bracket having a base and a body including a central portion connected to and upstanding from said base and a pair of wing members extending laterally from opposite sides of the central portion of said body, each of said wing members including an outer tip spaced from said base which defines a sheet-receiving recess, said cap member including a top and a pair of opposite depending flange members each including an outer edge;

attaching the bracket to a supporting roof structure;

positioning a flexible waterproof sheet over the wing members of said bracket body;

tucking said flexible sheet into one of said sheet-receiving recesses;

inserting an outer edge of one of the flange members of said cap member into said one sheet-receiving recess;

rolling said cap member over said bracket member; and crimping the flange members of said cap member toward each other until the outer edges of said flange members are disposed within said sheet-receiving recesses to sandwich and secure said sheet therebetween and provide a waterproof seal along said sheet-receiving recesses by said sheet bearing against said wing members.

14. The method of claim 13 wherein the step of crimping simultaneously moves the top of said cap members downwardly against said wing members to provide a longitudinal seal between the top of said cap member and said wing members.

* * * * *